US006619569B2

(12) United States Patent
Jens

(10) Patent No.: US 6,619,569 B2
(45) Date of Patent: Sep. 16, 2003

(54) EXTENDED REACH PRESSURE RELIEF SPRAY VALVE

(75) Inventor: Michael J. Jens, Minneapolis, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 09/905,710

(22) Filed: Apr. 24, 2001

(65) Prior Publication Data

US 2003/0089804 A1 May 15, 2003

(51) Int. Cl.[7] ..... B05B 7/02
(52) U.S. Cl. ..... 239/526; 239/532; 239/581.1
(58) Field of Search ..... 239/525, 526, 239/532, 581.1, 581.2, 582.1

(56) References Cited

U.S. PATENT DOCUMENTS

| | | | | |
|---|---|---|---|---|
| 1,605,185 A | | 11/1926 | Heinrich | |
| 1,960,724 A | | 5/1934 | Bramsen | |
| 4,013,225 A | | 3/1977 | Davis | 239/195 |
| 4,516,724 A | * | 5/1985 | Hellman | 239/119 |
| 4,660,771 A | | 4/1987 | Chabert et al. | 239/694 |
| 5,253,808 A | | 10/1993 | Pacht | 239/124 |
| 5,330,108 A | | 7/1994 | Grime et al. | 239/578 |
| 5,332,159 A | | 7/1994 | Grime et al. | 239/412 |
| 5,711,485 A | | 1/1998 | Wheeler | 239/105 |

* cited by examiner

*Primary Examiner*—Lisa A. Douglas
(74) *Attorney, Agent, or Firm*—Douglas B. Farrow

(57) ABSTRACT

The extended reach pressure relief spray valve mounts on the end of any length extension tube with any brand of spray gun or feeder valve. As the fluid is pumped through the spray gun and extension tube and into the spray valve, the pressure increases until it reaches an adjustable pressure relief set point (such as 1000 psi). At that point the valve opens and begins spraying. The relief spray valve doesn't require any long needles or cables to actuate the valve that results in a very simple extended reach pole gun. The relief spray valve opens by fluid pressure. Such fluid pressure can be easily adjusted by the user. The valve can be installed on any length pole. The spray relief valve is located next to the spray tip to minimize the paint from spitting and provides a sharp spray pattern. The spray relief valve is also built with a 180-degree swivel spray head for easy turn directional spraying.

2 Claims, 3 Drawing Sheets

EXTENDED REACH PRESSURE RELIEF SPRAY VALVE

RELATED APPLICATIONS

BACKGROUND OF THE INVENTION

A conventional pole gun is designed to allow a painter to spray paint or stain on high surfaces without the use of a ladder. The pole gun has a trigger mechanism connected to a full-length needle that is located at the tip to minimize the paint from spitting and dripping and provides a sharp spray pattern. The servicing and adjusting of the long needle is very difficult for the operator.

SUMMARY OF THE INVENTION

The extended reach pressure relief spray valve is used to apply paint, varnish or coating to out-of-reach areas easily. The mechanism converts any standard spray gun and extension pole into a pole gun. This dual use eliminates the need for a dedicated pole gun. Also, there are no long needles to replace and no complicated adjustments to be made by the user.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

Drawings of a preferred embodiment of the invention are annexed hereto so that the invention may be better and more fully understood, in which.

DESCRIPTION OF THE PREFERRED EMBODIMENT

Figure 1:
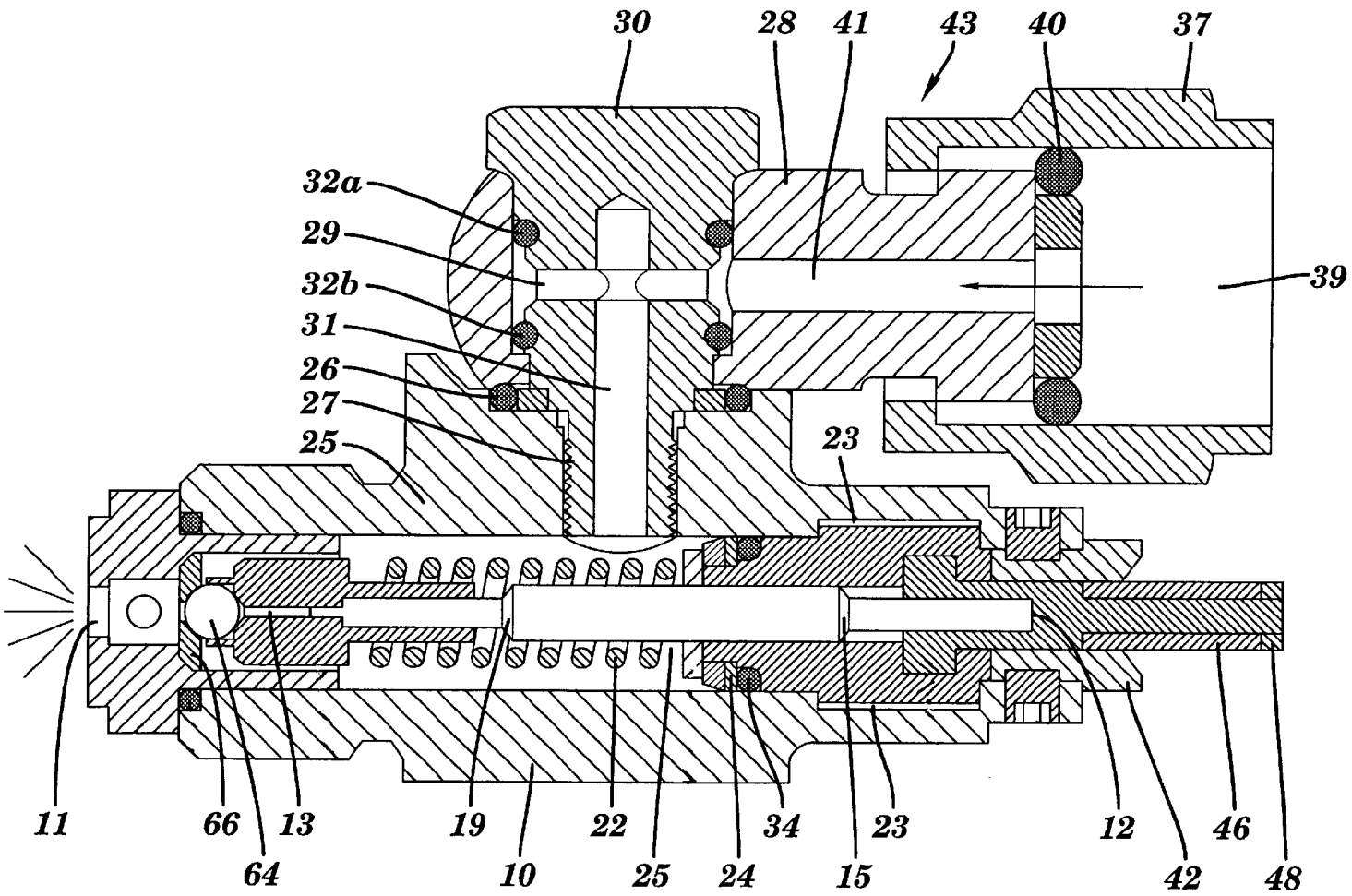
FIG. 1 is a side cross-sectional view of the internal workings of the valve and nozzle component.
Figure 2:
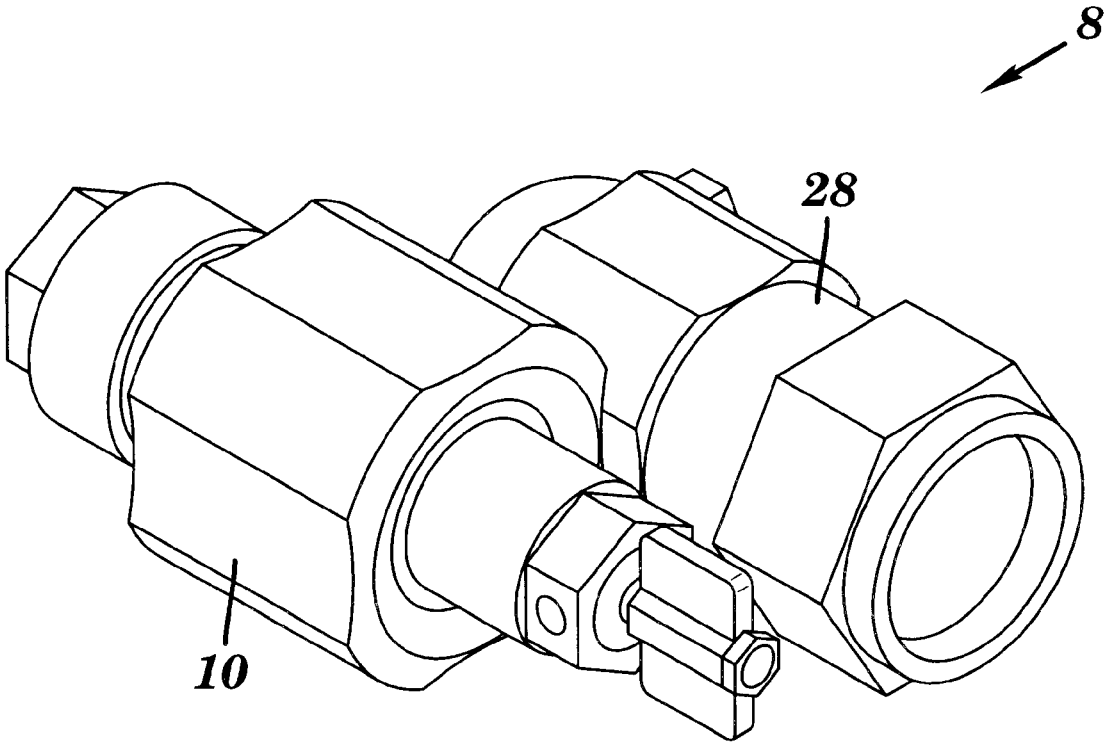
FIG. 2 is a view from the rear and below of the attachment, with the nozzle on the front.
Figure 3:
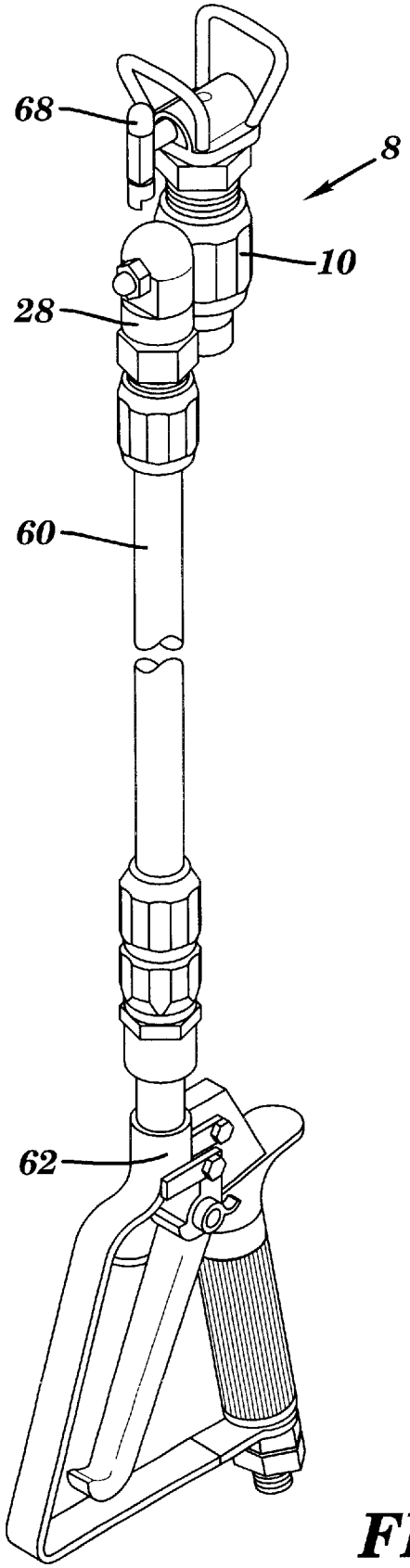
FIG. 3 is a perspective view showing the attachment on a spray gun and extension pole.

Referring to FIG. 1 of the drawing, the number 10 refers to the outlet member of the spray valve mechanism 8, which contains the valve and spray nozzle. 28 generally refers to the inlet member which receives, seals and directs the liquid to the valve mechanism.

30 refers to the head of a screw which enables the two components to connect, when inserted and threadedly engaged with the threads 27 of the outlet member 10. The screw 30 can rotate inside the inlet member 28.

Nut 37 will fit over and attach to the end of an extension pole 60 which in turn mounts on a conventional airless spray gun 62. Such an attachment creates an internal passage 39 for the liquid to travel through which is sealed to prevent leakage or loss of pressure with standard O-rings 40. The liquid then travels further down the passage 41 until it reaches an internal cylindrical chamber 29. This chamber is sealed with O-rings 32*a* and 32*b* as well. The chamber 29 has holes that allow the liquid to travel through a cylindrical hole 31 to the valve and nozzle component 10.

Upon the liquid entering the outlet member 10 it is pooled in a chamber 25 that articulates with and spills over into a chamber closer to the rear of the mechanism 23. The liquid then abuts and enters a crevice 12 wherein it applies hydraulic pressure to a plunger 15. The plunger 15 is supported by a spring 22 that keeps the plunger 15 in place by potential energy. When the hydraulic pressure is great enough to move the plunger 15 and depress the spring 22 so that the plunger passes a widening 24 of the crevice 12 then the pressurized liquid will enter the more forward portion of the crevice 19. The crevice 19 becomes smaller 13 and the pressurized liquid becomes increasingly pressurized on its way to the nozzle 11. Upon reaching the nozzle 11 the pressurized liquid is emitted from the mechanism at a pre-chosen pressure. In the preferred embodiment, this pressure is about 700 psi.

The degree of liquid pressure desired by the user may be adjusted by a simple valve handle 46 attached to the rearmost of the outlet member 10. Such valve handle 46, when rotated pulls ball 64 away from seat 66 to release internal pressure. Also, a ramp member 42 is located at the rearmost of the outlet member 10. When valve handle 46 is rotated approximately 90°, it forces plunger 15 rearwardly thereby relieving the internal pressure for flushing or maintenance. Such valve should be used to decrease internal pressure when there is a leak at any of the O-ring seals 40, 32*a*, 32*b*, 34 or 26.

A conventional reversible or flat airless tip 68 may be attached to the front nozzle 11 of the instant invention 8.

It is contemplated that various changes and modifications may be made to the extended reach pressure relief spray valve without departing from the spirit and scope of the invention as defined by the following claims.

What is claimed is:

1. A nozzle attachment in combination with and for threaded attachment to an extension pole attached to an airless spray gun or spraying a fluid under pressure, said nozzle attachment comprising:

a valve having a ramp member, an outlet, a spraying axis and rotatable between first and second positions along said axis, said first position allowing fluid to pass only when said pressure exceeds a predetermined amount, and said second position allowing fluid to flow freely for releasing pressure; and a valve handle connected to said valve for manually moving said valve using said ramp between said first and second positions said ramp member being shaped and positioned so as to more said valve between said positions upon rotation of said valve handle.

2. The nozzle attachment of claim 1 further comprising an inlet member and an outlet member, said inlet and outlet members being rotatable relative to each other with said valve being contained in said outlet member.

* * * * *